United States Patent [19]

Leary et al.

[11] Patent Number: 4,653,685

[45] Date of Patent: Mar. 31, 1987

[54] DUAL COMPARTMENT SANDWICH PACKAGE

[75] Inventors: Sharon M. Leary, Woodridge, Ill.; John C. Steward, Richardson, Tex.; Nicholas D. Commisso, Victor; Edwin R. De Cook, Oaks Corner, both of N.Y.; Ralph E. Hisle, Frankfort, Ill.; Donald Rowe, Newark, N.Y.

[73] Assignee: McDonald's Corporation, Oak Brook, Ill.

[21] Appl. No.: 752,168

[22] Filed: Jul. 3, 1985

[51] Int. Cl.[4] ..... B65D 1/34; B65D 1/42

[52] U.S. Cl. ..... 229/2.5 R; D9/341; D9/426; 220/4 B; 220/20; 229/43; 229/45 R; 426/115; 426/119; 426/129

[58] Field of Search ..... 229/2.5 R, 29 M, 43, 229/45 R; 220/4 B, 4 E, 23.8, 20; 426/113, 114, 115, 119, 120, 128, 129, 394, 397; D9/341, 426, 431, 432; 206/545

[56] References Cited

U.S. PATENT DOCUMENTS

| | | | |
|---|---|---|---|
| D. 243,507 | 3/1977 | Petersen | D9/190 |
| D. 252,913 | 9/1979 | Barcliff | D9/341 |
| D. 273,842 | 5/1984 | Jeannin | D9/341 |
| 2,096,825 | 10/1937 | Roman | 220/23.8 |
| 3,021,001 | 2/1962 | Donofrio | 206/56 |
| 3,184,133 | 5/1965 | Boyd et al. | 229/29 M |
| 3,258,187 | 6/1966 | Greatman | 229/2.5 R |
| 3,292,810 | 12/1966 | Schechter | 220/4 |
| 3,305,126 | 2/1967 | Cease | 220/23.83 |
| 3,595,425 | 7/1971 | Eicholtz | 220/20 |
| 3,633,785 | 1/1972 | Cyr | 220/20 |
| 3,754,640 | 8/1973 | Bridges | 220/23.8 |
| 3,845,875 | 11/1974 | Douglas et al. | 220/20 |
| 3,902,540 | 9/1975 | Commisso | 229/2.5 R |
| 3,908,852 | 9/1975 | Ricobene et al. | 206/545 |
| 3,933,296 | 1/1976 | Ruskin et al. | 229/2.5 R |
| 3,968,921 | 7/1976 | Jewell | 229/2.5 R |
| 3,984,027 | 10/1976 | Smith | 220/306 |
| 4,061,241 | 12/1977 | Retelny | 229/2.5 R |
| 4,132,344 | 1/1979 | Jewell | 229/2.5 R |

FOREIGN PATENT DOCUMENTS

| | | | |
|---|---|---|---|
| 2039459 | 2/1972 | Fed. Rep. of Germany | 206/545 |
| 2459765 | 2/1981 | France | 206/545 |
| 2025757 | 1/1980 | United Kingdom | 229/2.5 R |
| 2061880 | 5/1981 | United Kingdom | 220/339 |

*Primary Examiner*—William Price
*Assistant Examiner*—Gary E. Elkins
*Attorney, Agent, or Firm*—Jenner & Block

[57] ABSTRACT

A dual compartment sandwich package fabricated of foamed polystyrene or the like and adapted to retain therein in appealing and acceptable form a sandwich including a hot meat portion, such as a hamburger, and a cool trimmings portion, such as lettuce and tomato. The package includes a base and cover having central rib means for rigidifying the package and preventing bending about the longitudinal and transverse axes thereof. There are four cooperating slots and tabs for temporary or secure locking of the cover to the base, which latter condition also forms an external seal to prevent heat exchange with the ambient atmosphere, while the central rib means form an internal barrier to prevent transfer of air and heat between the two compartments. A method of packaging a hot meat portion-cool trimmings portion sandwich, such as a lettuce and tomato hamburger sandwich for dispensing and final assembly by a customer in such a dual compartment package is also disclosed.

23 Claims, 6 Drawing Figures

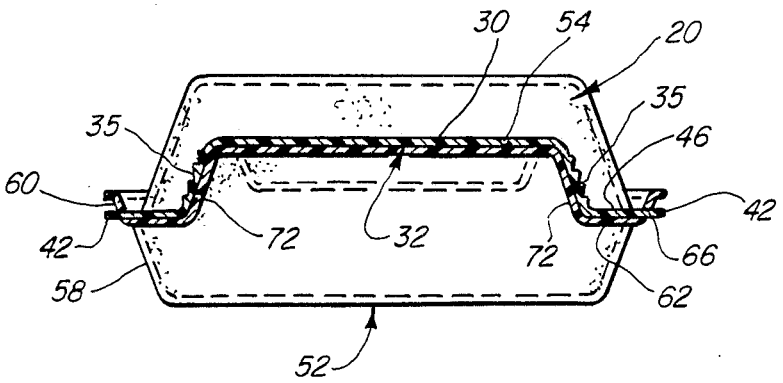
FIG. 4
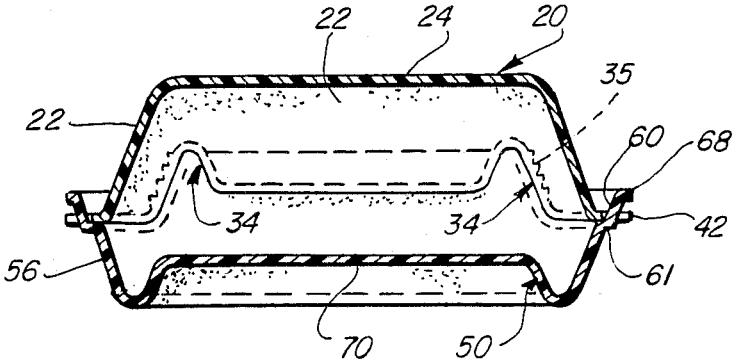
FIG. 5
FIG. 6
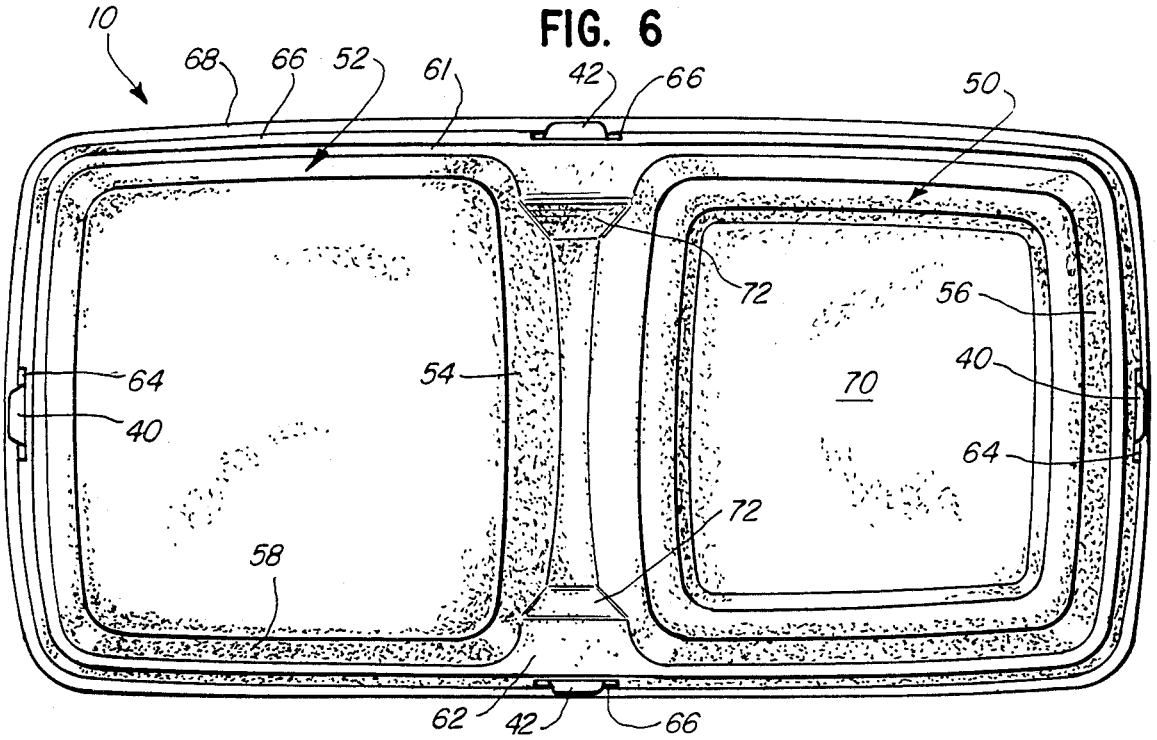

DUAL COMPARTMENT SANDWICH PACKAGE

BACKGROUND OF THE INVENTION

For some years now, hamburger sandwiches have been dispensed in foam packaging designed to hold sandwiches in acceptable condition for a predetermined period of time. Typical foam packages are shown in U.S. Pat. Nos. 4,132,344 and 3,902,540. Hamburger sandwiches of various types have been so dispensed by the hundreds of millions. Despite this wide usage, efforts to preassemble and hold sandwiches which include lettuce and tomatoes, or other fresh vegetables, in foam packaging have not been entirely satisfactory. The quality of such preassembled sandwiches when held for even short periods of time has not been as desirable as might be preferred.

A variety of efforts to design packaging for lettuce and tomato hamburger sandwiches have been made, including separating the meat and bun heel in one side of an open clamshell-type foam package and the lettuce, tomato, condiments, and bun crown in the other side of the open clamshell, and then placing them within a sleeve, such as a foam or paperboard sleeve, to contain them and for dispensing. Although there are a number of drawbacks to such packaging, such packaging will hold the sandwich components in acceptable condition for longer than a fully assembled sandwiched may be acceptably held.

Yet there remains the need for suitable packaging which will hold the components of a lettuce and tomato hamburger sandwich for an acceptable length of time, while maintaining desirable temperature and moisture levels of the meat, while maintaining the crispness and freshness of the lettuce and tomato, and while providing suitable convenience for the consumer.

SUMMARY OF THE INVENTION

In accordance with the present invention there is provided a dual compartment foam sandwich package having a pair of adjacent complementary food portion holding chambers especially adapted to hold open-faced halves of sandwiches, such as a first half comprising a hot hamburger product on a bun portion and a second half comprising cool trimmings, including lettuce and tomato. The package includes a foam base having two integrally formed compartments disposed in substantially planar side-by-side relationship and a base reinforcing means formed with the base for resisting bending of the base about the longitudinal and transverse axes of the base. A foam cover having a pair of integrally formed domes in substantially planar side-by-side relationship for covering said base and compartments is provided and includes cover reinforcing means on the cover for resisting bending about the longitudinal and transverse axes of the cover.

One of the domes is coextensive with one of the compartments to define a food portion holding chamber, and the other dome is coextensive with the other compartment to define a second food portion holding chamber.

Cooperating latching means are provided on the base and the cover for releasably securing together the base and cover in chamber forming array, and the base and cover reinforcing means cooperate to rigidify the package for resisting bending about the longitudinal and transverse axes thereof. The base reinforcing means may comprise an outwardly flared skirt integrally formed about the perimeter thereof, and the base reinforcing means may further comprise a transverse rib between the two compartments. The cover reinforcing means may comprise a transverse bridge connecting the pair of domes and may be adapted to mate with the base transverse rib in contour accommodating relationship.

Preferably, the latching means comprises a plurality of slots formed in the perimeter of the base and a plurality of outwardly projecting tabs on said cover insertable in said slots, and may comprise four each of the slots and tabs, with an opposed pair of the slots and tabs lying substantially on the transverse axis defined by the base rib and cover bridge.

In a preferred form, the cover bridge comprises finger-grippable means for flexing the opposed pair of tabs into and out of engagement with the opposed pair of slots, and the finger-grippable means comprises lateral struts and strut surfaces integrally formed at the opposite ends of the cover bridge. The top wall of each dome may comprise a plurality of serrations formed on the inner surface thereof to resist sticking thereto of the contained food portions.

Cooperating insulating means are provided on the base and cover, preferably to provide both an external seal for insulating the hot meat product and cool trimmings from the ambient atmosphere and to form an internal transverse barrier for minimizing transfer of air and heat from one of the chambers to the other, generally in the zone of the central transverse axis of said package. The cooperating insulating means may comprise the outwardly flared skirt integrally formed around the perimeter of the upper edge of the base and a complementary bottom edge of the cover to form the external seal.

The insulating means may further comprise an upwardly projecting transverse rib between the two compartments of the base and a transverse bridge connecting the pair of domes of the cover, the bridge receiving the rib therein in contour accommodating relationship when the latching means are engaged.

The method of this invention comprises the packaging of a hot meat sandwich with cool trimmings, such as lettuce and tomato trimmings, in a dual chambered package for final assembly of two open-faced sandwich portions into a single sandwich by a customer and for consumption by a customer, characterized by the steps of providing a foam package base having two integrally formed, adjacent compartments, integrally formed rigidifying and barrier means and first latching means, placing a first sandwich portion, including a bun section with a hot meat portion such as a hot hamburger patty thereon in one of the compartments, placing a second sandwich portion, including a bun section with a cool trimmings portion such as lettuce and tomato thereon in the other of the compartments, and providing a foam package cover having two integrally formed adjacent domes, integrally formed rigidifying and barrier means, and cooperating latching means, a first compartment and first dome being coextensive and forming a first chamber and a second compartment and second dome being coextensive and forming a second chamber, and positioning said cover over said base to form the chambers. Thereafter, the cooperating latching means are engaged with said first latching means to releasably close the package to form the chambers and simultaneously to effect a seal between the cover and base barrier means for minimizing transfer of air and heat between the hot meat portion and the cool trimmings, whereby when a customer opens the package, he may juxtapose the open-faced hot meat and cool trimming sandwich portions to assemble a sandwich, such as a lettuce and tomato hamburger sandwich.

Further objects, features, and advantages of the present invention will become apparent from the following description and drawings of a presently preferred embodiment thereof.

BRIEF DESCRIPTION OF THE DRAWINGS

FIG. 4 is a cross-sectional view taken substantially along line 4—4 of FIG. 2;

FIG. 5 is a cross-sectional view taken substantially along line 5—5 of FIG. 2; and FIG. 6 is a bottom view of the sandwich package of FIG. 1.

DESCRIPTION OF A PRESENTLY PREFERRED EMBODIMENT

Figure 1:
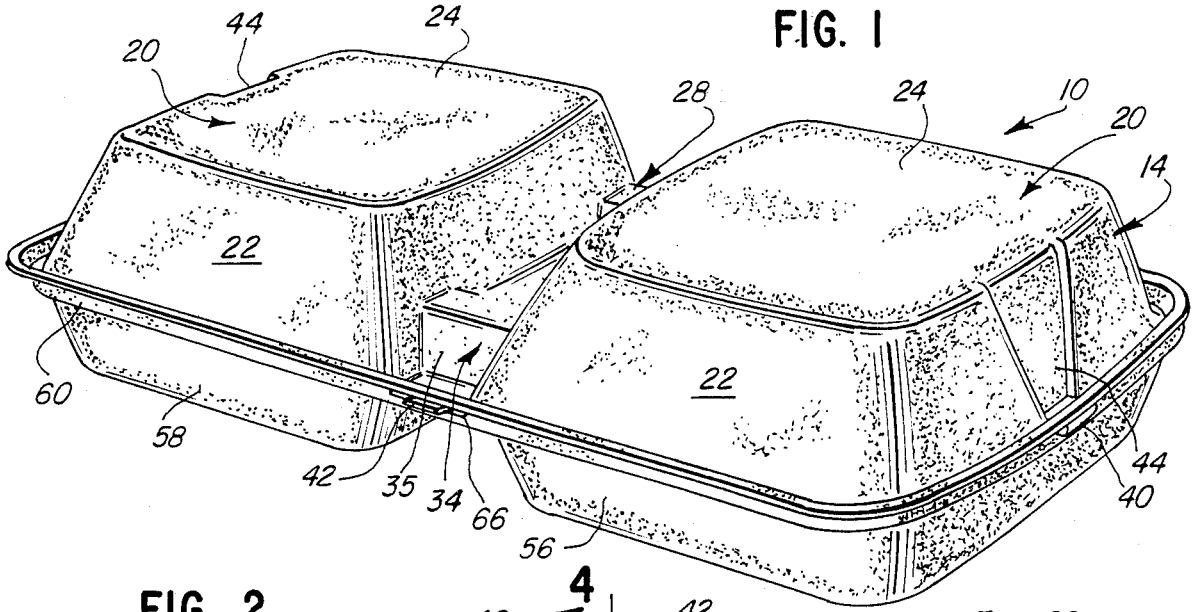
FIG. 1 is a top perspective view of a dual compartment sandwich package of the present invention.
Figure 2:
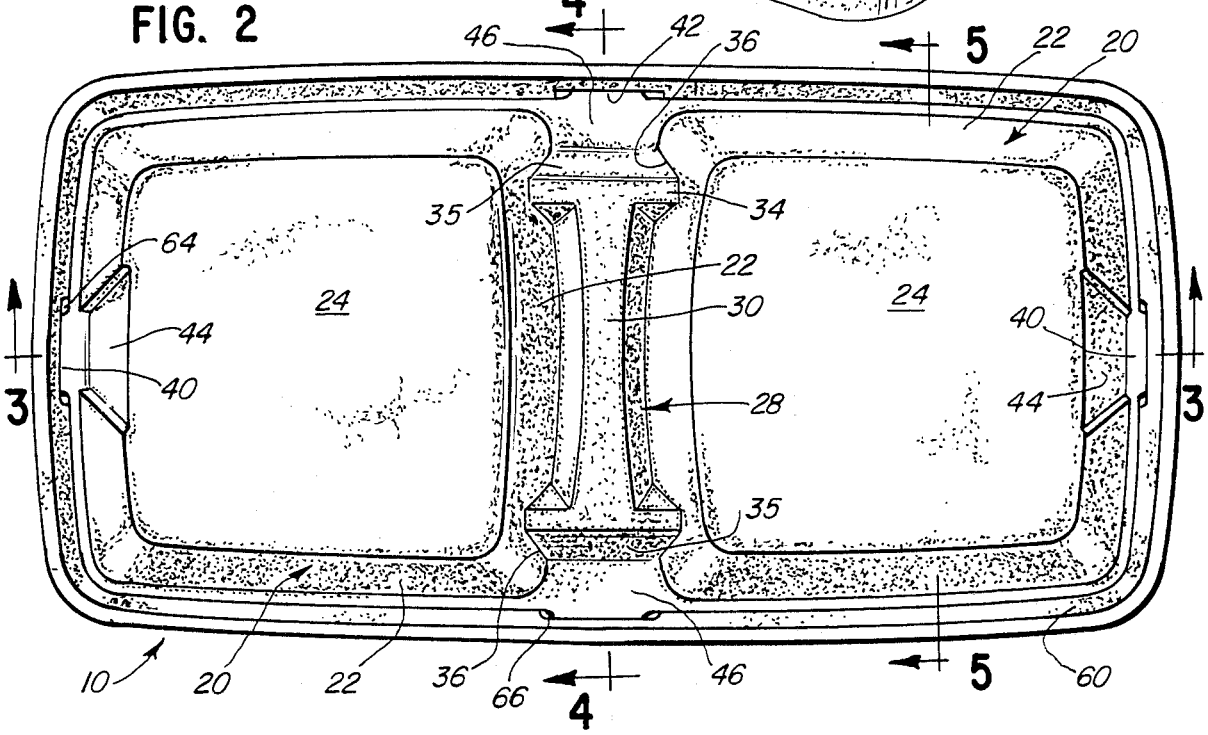
FIG. 2 is a top plan view of the sandwich package of FIG. 1.

Referring now to the drawings, FIG. 1 shows a dual compartment foam package 10 of the present invention. Package 10 comprises a base 12 and a separate cover 14 formed of foamed polystyrene or other suitable foamed material which are adapted to be juxtaposed with each other and to be releasably connected to each other.

Cover 14 is integrally formed and defines a pair of interconnected, generally rectangular, domes 20 located in substantially planar side-by-side array. Domes 20 may be substantially identical and each comprises side walls 22 which comprise an end wall, a pair of side walls, and an inner wall, all of which taper downwardly and outwardly from a top wall or panel 24. Panel 24 may provide a generally serrated inside surface, the serrations 26 comprising a series of parallel projections and valleys which, as will appear, serve to resist sticking of tomatoes and the like thereto.

Domes 20 are connected via an integral transverse reinforcing bridge 28 which comprises a rib and strut configuration. Bridge 28 lies along the transverse axis of the cover. Thus, an upwardly projecting rib 30 is positioned to lie between the domes 20. Rib 30 defines a downwardly opening groove 32 for a purpose which will later be described. Rib 30 terminates at its ends in a pair of finger-grippable, lateral struts 34 having outer strut walls 35. Struts 34 intersect and merge with the domes 20 at the ends 36 of the struts. Medially the struts 34 merge with the rib 30, thereby to provide the centrally reinforcing bridge 28 to serve to rigidify the cover 14, and to resist bending of the cover between the domes 20 about both the longitudinal and transverse axes of the cover.

The cover 14 further defines plural latching tabs, including a pair of end tabs 40, and side tabs 42 lying substantially on the transverse axis. To facilitate locating and gripping of the end tabs 40, each side wall 22 at the opposite end of the cover 14 defines a recess 44 which terminates at its base in an end tab 40. Each side tab 42 comprises a projecting extension of a cover segment 46 which merges with the reinforcing bridge 28.

Referring now to base 12, base 12 is seen to define a pair of internally formed, dished, generally rectangular, base compartments 50, 52 which have a common central wall comprising an upstanding transverse rib 54, which is adapted to mate with rib 30 in contour accommodating relationship. The compartments 50, 52 are disposed in substantially planar side-by-side array. Thus, the compartment 50 comprises a three-sided wall 56, comprising an upwardly tapering end wall and a pair of side walls, with a fourth or inner wall provided by rib 54, and compartment 52 comprises a similar three-sided wall 58, with a fourth or inner wall provided by upwardly tapering transverse rib 54. Each compartment has also an integral bottom wall. The periphery of base 12 is circumscribed by an outwardly flared perimetral skirt 60 which merges with walls 56, 58 along a narrow shelf 61 and with generally flat bridging segments 62 (see FIG. 6) which merge with rib 54. Skirt 60 defines a pair of end slots 64 and a pair of side slots 66 which are adapted, respectively, to lock with end tabs 40 and side tabs 42 to hold the cover and base together. Skirt 60 terminates outwardly in a narrow reinforcing flange 68.

Base compartment 50 is seen to define an upraised central pedestal 70 for a purpose to be described.

It will be seen that base 12 is so constructed that it is reinforced and rigidified against bending about its longitudinal and transverse axes by the flange 68, by the shape of rib 54, and by bridging segments 62. In particular, the ends 72 of rib 54 are generally triangular in configuration and merge with segments 62, thereby, with the flange 68 and skirt 60, tending to resist bending about the rib 54, i.e., about the transverse axis.

Figure 3:
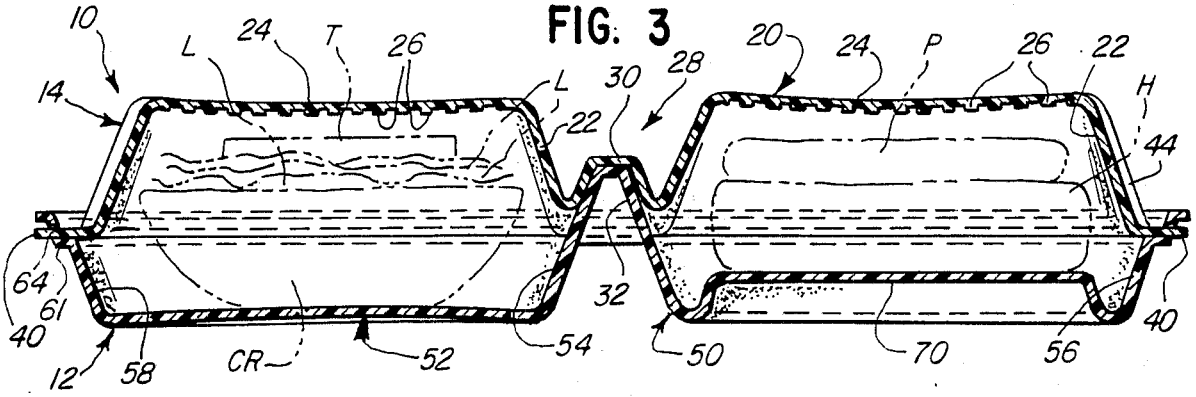
FIG. 3 is a cross-sectional view taken substantially along line 3—3 of FIG. 2.

It will be apparent that when the cover 14 and base 12 are juxtaposed and connected, the two compartments 50, 52 and overlying domes 20, each of which is coextensive with one of the underlying compartments 50, 52, form a pair of food portion holding chambers which are substantially insulated, sealed, and isolated from each other. For that purpose, the upper end of rib 54 snugly fits within groove 32 (see FIGS. 3, 4, and 5). The ends 72 of rib 54 preferably bear against the inner surfaces of outer strut walls 35. In any event, the nesting reception of the rib 54 in groove 32 of the reinforcing rib 30, which cooperates to rigidify the package to resist bending, also provides baffling and a primary and substantial barrier to the passage of heat and steam from one chamber to the other, as well as thermal insulation of the chambers from each other. Thus, air, moisture, and heat transfer between the chambers is minimized because of the barrier provided and tortuous path which must be followed for heat, air, and moisture to travel between the chambers. Further, it is apparent that the polystyrene foam material of which the cover and base are made have a degree of rigidity which contributes to the strength and rigidity of the package. To this end, the foam material may desirably be at least about 0.04 inch thick.

Further, for assembly of the cover and base, it will be apparent that the cover 14 may first be dropped onto the base 12. The base skirt 60 serves to nestingly receive the perimetral edge of the cover to provide an external or peripheral seal from ambient atmosphere thereat and to guide the positioning of the cover 14 relative to the base 12. The cooperating latching means on the base and cover, the tabs and slots, are then suitably engaged. Thus, the side tabs 42 may easily be inserted in the side slots 66 by squeezing the outer strut walls 35 between a finger and thumb to flex and retract the tabs 42 sufficiently to allow one to enter a side slot 66, following which finger pressure is released to permit the other tab 42 to expand into the confronting side slot 66. Preferably, the outer surfaces of the outer strut walls 35 are gently serrated to facilitate finger gripping. The end tabs 40 may then be speedily inserted in the end slots by simply squeezing the ends of the cover in recesses 44, and then allowing the cover to expand the tabs 40 into the end slots 64.

Especially when assembled with contents, the package 10 of the present invention is quite rigid when held by one end, as by gripping and holding the assembled package near one end tab. Stated another way, the package will not sag or bend significantly about the transverse axis of the cover and base when so held. This is quite important, both when the package is to be "dispensed" to a customer, and while the package is being transported and handled by the customer. The ridigity is provided by the reinforcing bridge 28 and associated rib and strut construction of the cover 14, as well as by the rib, skirt, and flange construction of the base 12. It will also be noted that the face-to-face contact of the two ribs 30 and 54 serves to further enhance such rigidity. The skirt construction 60, in cooperation with the edges of the side walls 22 and cover segments 46 which tend to bear against inner surfaces of the skirts 46, also serves to help insulate the package contents from ambient atmosphere, which may well be a heated holding bin designed especially to help maintain the proper holding temperature for the product. The placement of the tabs and slots for securing the base and cover to each other also assist in maintaining the desired peripheral seal between the cover edge and base skirt.

In particular, the method of this invention is especially adaptable to the packaging of a sandwich such as a hamburger sandwich with lettuce and tomato trimming in a dual-chambered package for final assembly of two open-faced sandwich portions into a single sandwich by a customer and for consumption by a customer. It is characterized by the steps of providing a foam package base having two integrally formed adjacent compartments, integrally formed rigidifying and barrier means and first latching means, placing a first sandwich portion, including a bun section with a hot hamburger patty thereon, in one of said compartments, placing a second sandwich portion, including a bun section with cool lettuce and tomato thereon, in the other of said compartments, and providing a foam package cover having two integrally formed adjacent domes, integrally formed rigidifying and barrier means, and cooperating latching means, a first compartment and first dome being coextensive and forming a first chamber and a second compartment and second dome being coextensive and forming a second chamber, and positioning the cover over the base to form the chambers. Thereafter, the cooperating latching means are engaged with said first latching means to releasably close the package to form the chambers and simultaneously to effect a seal between said cover and base barrier means for minimizing transfer of air and heat between said hot hamburger patty and cool lettuce and tomato, whereby when a customer opens the package, he may juxtapose the open-faced sandwich portions to assemble a lettuce and tomato hamburger sandwich.

In practice, the ingredients of a hamburger sandwich to be disposed in a package 10 may be cooked and otherwise prepared in a conventional manner. The dual compartment foam package is especially adapted to receive open-face halves of a sandwich, including a hot meat product and cool trimmings. To that end, a hot hamburger patty P is disposed on a heel H of a bun and positioned in compartment 50 on pedestal 70. The cool trimmings, such as the condiments C, lettuce L, and tomato T are disposed on the crown CR of the bun and position of the base of the other compartment 52. The pedestal 70 serves to elevate the heel and patty to a level with the crown and lettuce and tomato. The cover 14 is then juxtaposed with base 12, is connected via the locking tabs and slots, thereby to form separate chambers for the hot meat and cool trimmings, and the sandwich is ready to be dispensed or to be held in a conventional holding bin for up to about 10 minutes, depending upon the nature of the sandwich, without deleterious effect. After the sandwich is dispensed in package 10, a customer can readily open the package by flexing at the strut walls 35 or cover surfaces 44 to disengage the tabs and, to assemble the sandwich, need only pick out the heel H and hamburger P, invert it over the crown CR, condiments C, lettuce L, and tomato T, and the sandwich will be ready for consumption.

Although the cover 14 has an inside fit relative to the base 12, enhancing the assembly of cover 14 to base 12 and facilitating removal thereof by the customer, the cover may be constructed so that it receives the base, as by providing a skirt 60 on the cover and suitable locking tabs on the base. It is also apparent that the insulating baffling and barrier to interchange of the atmospheres of the compartments may be differently formed and indeed that the base may be provided with a reinforcing bridge, like bridge 28, and the cover with a baffling rib, like rib 54. Further, although the cover and base are shown as separate, they may be hingedly connected at one end or side.

Still other modifications will become apparent to those skilled in the art from the foregoing description and appended drawings. Accordingly, the invention herein is not to be construed as being limited, except insofar as the claims may require.

What is claimed is:

1. A foam sandwich package having a pair of adjacent complementary food portion holding chambers comprising:

a foam base having two integrally formed compartments located in substantially planar side-by-side relationship along an imaginery longitudinal axis;

a foam cover having a pair of integrally formed domes in substantially planar side-by-side relationship for covering said base compartments the cover further having cover reinforcing means for resisting bending about imaginary longitudinal and transverse axes oriented parallel to the respective base axes;

one said dome being coextensive with one said compartment to define a first food portion holding chamber, the other said dome being coextensive with the other said compartment to define a second food portion holding chamber;

base reinforcing and barrier means including a bi-ended rib located between the base compartments and having a predetermined upper surface profile extending above the adjacent compartments, the rib extending along an imaginary transverse axis normal to the longitudinal axis and cover reinforcing and barrier means including a transversly extending bi-ended rib located between but spaced apart from the cover domes and having an open lower surface profile adapted to mate with the base transverse rib with surface-to-surface contact, the cover reinforcing and barrier means further including a plurality of reinforcing struts, each strut extending longitudinally between the cover domes and joining an end of the cover rib to form an H-patterned reinforcement structure between the domes to rigidify the closed package so as to resist package bending along the longitudinal and transverse axes.

2. A foam sandwich package according to claim 1 wherein said base reinforcing means comprises an outwardly flared skirt integrally formed about the perimeter thereof.

3. A foam sandwich package according to claim 1 further including latching means comprising a plurality of slots formed in the perimeter of said base and a plurality of outwardly projecting tabs on said cover insertable in said slots.

4. A foam sandwich package according to claim 3, wherein said cover and base are separate, and wherein there are four each of said slots and tabs, an opposed pair of said slots and tabs lying substantially on the transverse axis defined by said base rib and cover bridge.

5. A foam sandwich package according to claim 4 wherein said struts define finger grippable means on opposite sides of the area for flexing the said opposed pair of tabs into and out of engagement with said opposed pair of slots.

6. A foam sandwich package according to claim 1 wherein the top wall of each of said domes comprises a plurality of serrations formed on the inner surface thereof to resist sticking thereto of contained food portions.

7. A foam sandwich package according to claim 1 wherein the bottom wall of one of said compartments comprises an upraised pedestal formed in the central portion thereof.

8. A foam sandwich package according to claim 1 further including an outwardly flared rigidifying skirt extending upwardly from the outer ridges of each case compartment.

9. A foam sandwich package according to claim 1 wherein said base rib upper surface and said cover rib lower surface each include curved convolutions adapted to mate with one another to further inhibit the transfer of heat and moisture from one compartment to another in the closed foam sandwich package.

10. A dual compartment foam package having a pair of adjacent complementary food portion holding chambers for the open-face halves of a sandwich, including a hot meat product and cool trimmings, such as lettuce and tomato and the like, comprising:

a foam base having two integrally formed compartments in substantially planar side-by-side longitudinal relationship;

a foam cover having a pair of integrally formed domes in substantially planar side-by-side longitudinal relationship for covering said base;

one said dome being coextensive with one said compartment to define a first chamber, the other said dome being coextensive with said other compartment to define a second chamber;

cooperating latching means on said base and on said cover for releasably securing together said base and cover in chamber-forming array; insulating means forming an external seal for insulating the hot meat product and cool trimmings from the ambient atmosphere base reinforcing and barrier means including a transversely extending bi-ended rib located between the base compartments and having a pre-determined upper surface profile extending above the adjacent compartments, the ends of the rib being transversely spaced apart from the insulating means to define recesses and cover reinforcing and barrier means including a transversly extending bi-ended rib located between but spaced apart from the cover domes and having an open lower surface profile adapted to mate with the base transverse rib with surface-to-surface contact, the cover end reinforcing barrier means further including a plurality of reinforcing struts, each strut extending longitudnally between the cover domes and joining an end of the cover rib to form an H-patterned reinforcement structure between the domes to rigidify the closed package so as to resist package bending along the longitudinal and transverse axes.

11. A dual compartment package according to claim 10 wherein said latching means comprises a plurality of slots in a perimetral upper edge of said base and a plurality of tabs extending outwardly from a peripheral bottom edge of said cover, said tabs being insertable in said slots.

12. A dual compartment package according to claim 11 wherein said cover and base are separate, and wherein there are four each of said slots and tabs, one opposed pair of said slots and tabs lying substantially on the central transverse axis of said package.

13. A dual compartment package according to claim 10 wherein said insulating means comprises an outwardly flared skirt integrally formed around the perimeter of the upper edge of said base and a bottom edge of said cover, said bottom edge cooperating with said skirt to form said external seal.

14. A dual compartment package according to claim 10 further including lateral finger grippable surfaces located on said struts adjacent said latching means for flexing the adjacent cover latching means into and out of engagement with said cooperating base latching means.

15. A dual compartment package according to claim 10 wherein one of said base compartments comprises an upraised pedestal formed in the bottom wall thereof for retaining thereon a bun heel with the hot meat product thereon, the other of said compartments being adapted to retain a bun crown with the cool trimmings thereon.

16. A dual compartment package according to claim 15 wherein the top wall of each of said domes comprises a plurality of serrations formed on the inner surface thereof for resisting sticking thereto of the hot meat and cool trimmings.

17. A foam sandwich package comprising a pair of adjacent chambers for holding complementary food portions, each chamber comprising a coextensive compartment and dome, a first package portion having two integrally formed open-topped compartments in substantially planar side-by-side longitudinal relationship, each of said compartments comprising a bottom wall, an upwardly tapering end wall, and a pair of side walls;

a second package portion having a pair of integrally formed domes in substantially planar side-by-side longitudinal relationship for covering said first package portion, each of said domes comprising a top wall, a downwardly tapering end wall, and a pair of side walls, cooperating latching means on said first and on second package portions of releasably securing together said package portions in chamber-forming array;

base reinforcing and barrier means including a transversely extending bi-ended rib located between the base compartments and having a predetermined upper surface profile extending above the adjacent compartments, and cover reinforcing and barrier means including a transversly extending bit-ended rib located between but spaced apart from the cover domes and having an open lower surface profile adapted to mate with the base transverse rib with surface-to-surface contact, the cover and reinforcing barrier means further including a plurality of reinforcing struts, each strut extending longitudinally between the cover domes and joining an end of the cover rib to form an H-patterned reinforcement structure between the domes to rigidify the closed package so as to resist package bending along the longitudinal and transverse axes.

18. A foam sandwich package according to claim 17, wherein one of said package portions defines an outwardly flaring perimetral skirt and the other defines a complementary perimetral edge to be received by said skirt, and wherein said package portions are separately formed.

19. A foam sandwich package according to claim 18 wherein said first and second package portions are separate and said latching means comprises a slot formed in said skirt adjacent each of said first package portion end walls, a pair of opposed slots formed in said skirt in substantial alignment with said rib, and four tabs extending outwardly from the perimetral edge of said second package portion and insertable in said slots.

20. A foam sandwich package according to claim 19 further including lateral strut surfaces, said strut surfaces being finger-grippable for flexing the associated tabs into and out of engagement with their respective slots, independently of the engagement of the tabs with their respective slots.

21. A foam sandwich package according to claim 17 wherein the bottom wall of one of said compartments comprises a central upraised pedestal, said one compartment being adapted to retain a bun heel with a hot meat product thereon, the other of said compartments being adapted to retain a bun crown with cool lettuce and tomato thereon.

22. A foam sandwich package according to claim 21 wherein said top walls and said domes comprise a plurality of serrations formed on the inner surfaces thereof for resisting sticking thereto of said hot meat product and cool lettuce and tomato.

23. A foam sandwich package according to claim 17, and wherein one said chamber contains a bun portion and hamburger patty, and the other said chamber contains a bun portion and lettuce and tomato thereon.

* * * * *